United States Patent [19]

Lades et al.

[11] Patent Number: 4,509,178

[45] Date of Patent: Apr. 2, 1985

[54] ARRANGEMENT OF AN ELECTRODE FOR ELECTRIC ARC FURNACES

[75] Inventors: Hans Lades, Schwaig; Friedrich Fink, Lauf a. d. Pegnitz; Siegfried Liebel, Röthenbach; Inge Lauterbach, Nuremberg; Thomas Taube, Erlangen-Steudach; Dieter Zöllner, Schwaig, all of Fed. Rep. of Germany

[73] Assignee: Arc Technologies Systems Ltd., Cayman Islands

[21] Appl. No.: 487,119

[22] Filed: Apr. 21, 1983

[30] Foreign Application Priority Data

Apr. 23, 1982 [CH] Switzerland ..... 2503/82

[51] Int. Cl.[3] ..... H05B 7/07

[52] U.S. Cl. ..... 373/93; 373/90; 373/94; 373/101

[58] Field of Search ..... 373/90–93, 373/99, 94, 101

[56] References Cited

U.S. PATENT DOCUMENTS

| | | | |
|---|---|---|---|
| 2,600,823 | 6/1952 | Zaccagnini | 373/93 |
| 3,377,418 | 4/1968 | DeCorso et al. | 373/90 |
| 3,489,841 | 1/1970 | Cheng | 373/93 |
| 4,291,190 | 9/1981 | Elsner | 373/93 |

*Primary Examiner*—A. D. Pellinen
*Assistant Examiner*—Susan Steward
*Attorney, Agent, or Firm*—John J. Freer

[57] ABSTRACT

An electrode for electric arc furnaces, comprising an upper, metallic, water-cooled section and a lower section of consumable material, such as graphite, is held in its given position by means of an electrode support arm 1,2. The connection elements for electric power and liquid coolant 12, 6, 25 are integrated in the electrode support arm and are designed as plug connections.

10 Claims, 2 Drawing Figures

ARRANGEMENT OF AN ELECTRODE FOR ELECTRIC ARC FURNACES

FIELD OF THE INVENTION

This invention relates to electrodes for use in electric arc furnaces, the electrodes having a metallic, liquid-cooler upper section and a lower section of a consumable material attached to the upper section. More particularly, this invention relates to means for supporting such electrodes within arc electrode furnaces and means for connecting electrical power and coolant to such electrodes while in use in such furnaces.

BACKGROUND OF THE INVENTION

Electrodes having a metallic, liquid-cooled, upper section and a lower section of a consumable material, preferably graphite, attached to the upper section, are generally known as combination electrodes. European patent application No. 80106581.4 describes such a combination electrode. Having demonstrated utility, such electrodes are replacing more conventional graphite electrodes to an increasing degree.

Problems of how to connect such combination electrodes to necessary facilities, such as electrical power or coolant, and how to attach or insert the electrodes into an electrode support at the electric arc furnace have not yet been solved satisfactorily. At present, conventional electrode support arms are simply modified to fit a combination electrode without departing from an established design concept. Typically, on the side of a combination electrode, conventional, vertically movable, swivelling electrode support arms encompass radially movable clamping jaws between which the electrode to be employed is inserted by means of a hoist. The clamping jaws are consequently pressed against the sheath area of the electrode. In this way the electrode is supportively fastened in a positive manner. At the same time the clamping jaws serve as an electrical contact arrangement for the transition of electric current to current-carrying components of the electrode. Where graphite electrodes are used, the clamping jaws encompass the graphite column at the upper end, while the clamping jaws for combination electrodes encompass the metallic section of the combination electrode directly or contact the metallic section via conductive intermediate elements.

Where combination electrodes are used, it is relatively complicated to use conventional electrode support arms, since, in addition to the usual handling operations, it is necessary to connect a liquid coolant system. Connection is achieved in a separate operation as the electrode is set to work. On the other hand, such a coolant system requires disconnection in a separate operation when the electrode in question is replaced. These operations consume not only significant time but are also difficult, being carried out under extreme working conditions upon or adjacent the operating furnace.

DISCLOSURE OF THE INVENTION

The object of the present invention is to provide a means and method for the installation and connection of combination electrodes to an electric arc furnace, with the respective combination electrode being brought into operation or out of operation in a single operation.

The instant invention provides a mechanical fastening element and connection elements for the electric current and the liquid coolant integrated within the electrode support arm, and that such elements as well as corresponding elements on the combination electrode are configured as plug connections.

Employing an electrode support arm according to the instant invention, incorporating all elements or connection units required for the operation of a combination electrode, it is possible to connect the electrode to an electrode support arm and thus put it into operating condition in a single operation, while the electrode can be similarly disconnected from the support arm where it is to be put out of operation. Facile interconnection is possible because all elements are configured as plug connections. In this way the electrode is simultaneously connected to the electrode support arm and to the mechanical fastening element on the one hand, and to the connections for electric power and liquid coolant on the other hand, while disconnection is equally facile when it is put out of operation. Consequently, considerable handling time is saved.

At the same time the connection arrangement in accordance with the instant invention is very compact, because the electrode and electrode support arm constitute a constructive unit, making for more flexibility in furnace design.

The electrode support arm includes a receiving element having a vertical axis open at the bottom to receive the upper end of an electrode which is inserted into this receiving element from below. Therefore the electrode in question can be inserted into the electrode support arm from below and be fastened to the electrode support arm in a single operation, while the connections for electric power and liquid coolant are simultaneously established. Furthermore, the electrode support arm may be designed as a box-like welded structure. Such an electrode support arm may then be used to house more sensitive components of the connection arrangement between electrode and electrode support arm to provide protection against dirt or damage.

It is advantageous if a fastening element between the electrode and the electrode support arm is configured as a positive means of fastening located in the receiving element.

Such a fastening element constitutes not only a simple, locking connection between the electrode and the electrode support arm, but also a connection capable of elevated mechanical loading that can be disconnected. Simplicity is possible because this new concept is based on the idea that the mechanical means of fastening and the electrical contact arrangement belong to two different groups of components, contrary to conventional electrode support arms where the clamping jaws also provide for electrical contacts.

In order to have a simple set-up and provide for reliable functioning of the positive fastening element, this fastening is designed as a bayonet catch. A bayonet ring of the fastening element is coaxially pivoted within the receiving element of the electrode support arm, with the electrode having radial bayonet locking elements at the upper end of the sheathed area of the metallic section which reach behind the bayonet ring of the electrode support arm when the electrode is in locked position. To further facilitate work it is often advantageous for the bayonet ring of the electrode support arm to be operated pneumatically, hydraulically or by electric motor, resulting in a further automatization of the operation or handling of combination electrodes.

Alternately, the bayonet ring may also be rigidly positioned and the electrode be rotated to lock the ring with the electrode support arm.

The connecting element for the electric current is also located in the receiving element, while a corresponding element is positioned at the upper end of the electrode. These elements engage with the electrode support arm preferably in a non-positive manner when the electrode is in operating position. Thus the plug connection also comprises the electrical contacts of the electrode.

In an alternate preferred embodiment of the invention, the electrical connection element in the electrode support arm comprises a connection piece coaxially positioned in the receiving element. The lower end of this connection piece is tapered, having a generally cone-shaped exterior surface, while the electrode at its upper end includes a ring having a correspondingly cone-shaped interior surface.

This conical connection results in a snug contact between the contact areas of the electrode support arm on the one hand and the electrode on the other. Only a minor electric transition resistance results and, consequently, only slight losses in electrical efficiency.

The establishment of electric contacts between the electrode support arm on the one hand and the electrode on the other hand is further improved by the connection piece of the electrode support arm and the ring of the electrode while positioned for operation are pressed each against the other by an arrangement of springs acting coaxially against them. The arrangement of springs provides not only an excellent contact between the cone-shaped contact areas, but maintains reliable contact therebetween regardless of the existence of any subsidiary sources or supplies of power or not.

Furthermore, the cone arrangement also contributes to the exact alignment of the electrode.

For a simple and rapid disconnection of the electrode from the electrode support arm it is advantageous for the connection piece and the ring to be disengagable by a disengagement mechanism operable pneumatically, hydraulically or by electric motor.

In certain preferred alternate embodiments of the invention, the receiving element of the electrode support arm includes a connection element for supplying liquid coolant to the electrode, while a corresponding coolant connector element is located at the upper end of the electrode.

The close vicinity of electric contacts and liquid coolant connection offers the simple possibility of cooling the electrode as well as the electrical contact zone employing a single cooling system.

With the plug connection providing a fluid pathway between the electrode and a liquid coolant supply, the construction generally provides an electrode having a central pipe for supplying the liquid coolant generally connected to a coaxial supply piece located in the receiving element of the electrode support arm, while the liquid coolant is discharged from the electrode through a pipe surrounding the central duct, with a discharge piece in the receiving element of the electrode support arm being coaxially configured relative to the supply duct for connection to the discharge duct of the electrode.

A very simple and compact assembly results, related to the connection piece of the electric connection element having the shape of a hollow cylinder, in which the supply piece for the liquid coolant is coaxially located, a portion of which also serves as a discharge for the liquid coolant. This results in a specially intensive cooling of the electric contact zone. The supply and discharge ducts for the liquid coolant also act as conductors for the electric current.

It is, of course, necessary to electrically insulate that part of the electrode support arm which contains the receiving element for the electrode against the remaining part of the same.

The above and other features and advantages of the invention will become apparent from the following detailed description of the invention made with reference to the accompanying drawing which togethr form a part of the specification.

DETAILED DESCRIPTION OF THE INVENTION

Figure 1:
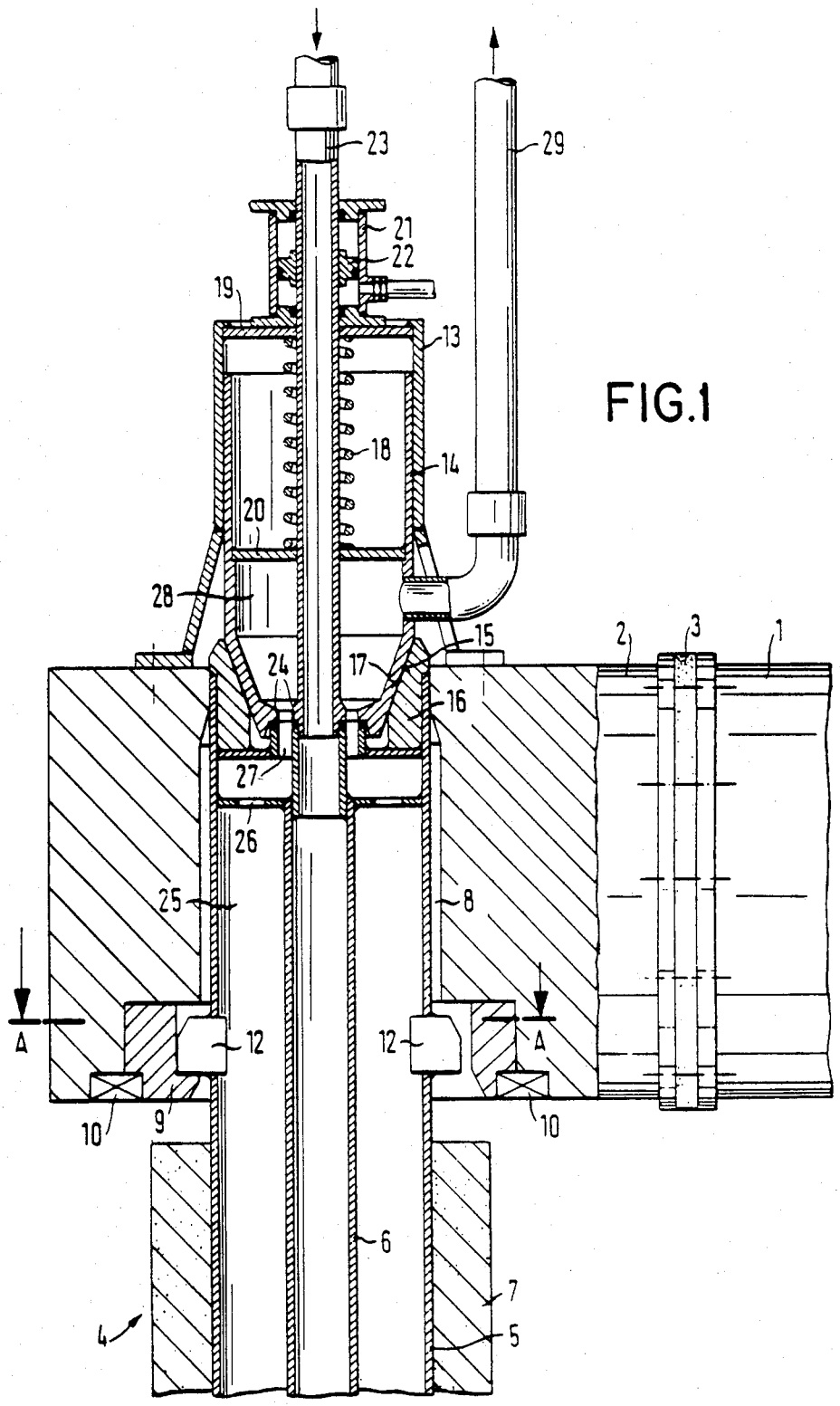
FIG. 1 is a side elevational view in section of one embodiment of a constructive unit according to the invention, having an electrode support arm and a combination electrode.
Figure 2:
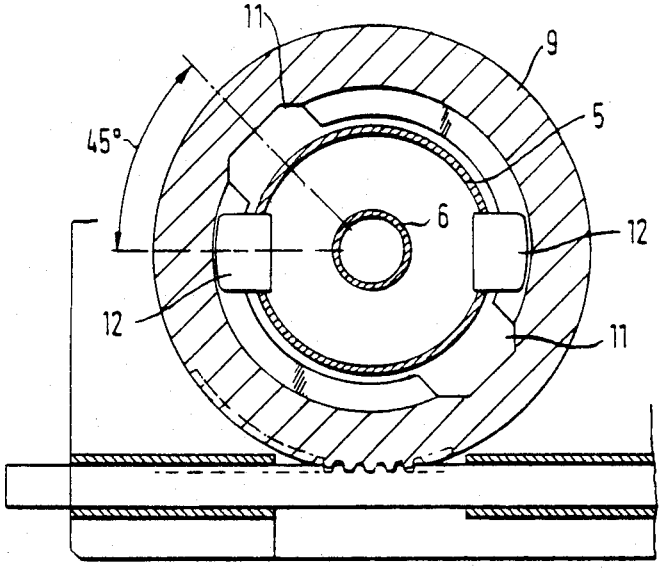
FIG. 2 is a cross section according to line A—A of FIG. 1.

Referring to the drawings, FIG. 1 shows an end of an electrode support arm 1 at the side of an electrode. The electrode support arm 1 includes mechanisms for vertical lifting, lowering, or swivelling (not shown) of conventional type. On one side of the electrode the electrode support arm 1 includes a portion 2 electrically insulated against the remainder of the electrode support arm by means of an insulator 3. When the portion 2 is connected to the remainder of the electrode support arm 1, this insulation 3 is inserted first. The connection is then effected by means of a suitable or conventional flange bolt connection shown only schematically.

For the electrode support arm 1 a combination electrode is employed having an upper, metallic section 4, illustrated schematically. The upper metallic section 4 comprises an exterior duct 5 and a central pipe 6 coaxially arranged within the exterior duct 5. The metallic upper section 4 of the combination electrode is protected by a protective jacket 7.

The portion 2 of the electrode support arm 1 which is directed towards the electrode comprises a receiving element 8 with a vertical axis having the shape of a hollow cylinder and open on the bottom side. The interior diameter of this receiving element basically corresponds to the exterior diameter of the metallic upper section 4 of the electrode, so that the upper end of the metallic section 4 of the electrode can be inserted from below into the receiving element 8 of the portion 2 of the electrode support arm 1. The receiving element and the upper section of the electrode are configured to assure mechanical stability.

The mechanical connection or locking of the electrode to the receiving element 8 of the electrode support arm 1 is effected by a mechanical, positive fastening element. This element comprises a bayonet ring 9, located at the lower end of the receiving element coaxially to its axis and pivoted on a bearing 10 illustrated only schematically. As can be seen from section A—A, the bayonet ring 9 has two diametrically opposite, radial recesses 11. Corresponding to these recesses 11 of the bayonet ring 9 are two diametrically opposite bayonet locking elements 12 on the exterior sheath area of the metallic section 4 of the electrode. When the upper end of the metallic section 4 of the electrode is inserted into the receiving element 8 of the electrode support arm 1, these locking elements can be moved through the recesses 11 of the bayonet ring 9 to lie above the bayonet ring 9, which can then be turned for engagement. The locking elements 12 of the electrode thereupon reach behind the bayonet ring 9, to provide a positive locking or fastening of the electrode in the electrode support arm 1. The bayonet ring 9 may be turned manually, pneumatically, hydraulically or by electric motor (now shown).

In order to establish the connections for electric power and liquid coolant simultaneously with the coupling of electrode and electrode support arm 1, the electrode support arm 1 and the upper metallic section 4 of the electrode comprise the following components.

At the upper end the recess 8 is followed by a bearing case 13, having the shape of a hollow cylinder and located coaxially to the axis of the recess. This bearing case 13 may be of suitable welded construction. The bearing case 13 includes a connection piece 14, having generally the shape of a hollow cylinder and is coaxially and axially movable. The connection piece 14 provides for the connection of the electric current as well as the liquid coolant. For this purpose the lower end of the connection piece 14 includes a conically tapering exterior surface 15.

At the upper end of the metallic section 4 of the electrode there is a contact ring 6 with a corresponding conical interior surface 17. The contact ring 16 may be welded on the exterior pipe 5 or duct of the electrode. When the electrode is positioned in the electrode support arm in the operating position, the conical exterior surface 15 of the connection piece 14 and the conical interior surface 17 of the contact ring 16 engage. Engagement is assisted by the action of a set of helical compression springs 18, located between a closing wall 19 of the bearing case 13 and a partition wall 20 of the connection piece 14, thus pressing down upon the latter. If the electrode has to be disconnected, the connection piece 14 can be somewhat lifted against the spring arrangement 18 by the action of a pneumatic cylinder 21, having a piston 22 interacting with a supply piece 23 jointed rigidly and coaxially to the connection piece 14.

This supply piece 23 provides the simultaneous supply of liquid coolant and electric current. For supplying the liquid coolant to the central pipe 6 of the electrode, this central pipe 6 or duct may be connected in alignment to the supply piece 23. One of the supply piece 23 or the central pipe 6 is equipped with a seal 24, providing a liquid-tight connection between the supply piece 23 and the central pipe 6. The electrical current is supplied via the supply piece 23 to the connection piece 14, and thence to the contact ring 16 of the electrode. From there the current is supplied via the exterior duct 5 and the central pipe 6 to the lower consumable section of the electrode, preferably of graphite material.

A ring cavity 25, located in the electrode between the exterior duct 5 and the central pipe 6, is used for the discharge of the liquid coolant. From there the liquid coolant passes via bores 26 and a further ring cavity 27 to the lower part of the connection piece 14, which performs as a discharge piece 28, from which the liquid coolant passes via a discharge pipe 29 to the liquid coolant source for recirculation. The discharge pipe 29 may also be used for electrical current supply, for here too the electric current may be transferred via a connection piece 14 to the contact ring 16.

All current-carrying components consist of an electrically highly conductive material, such as copper.

While a preferred embodiment of the invention has been described in detail, it will be apparent that various modifications or alterations may be made therein without departing from the spirit and scope of the invention as set forth in the appended claims.

We claim:

1. An electrode and electrode support arrangement for use in an electric arc furnace, the electrode having a metallic, cooled upper section to which a lower section of consumable material is attached, the electrode support arrangement having a movable arm and having connections for supplying electric current and coolant to the electrode, and comprising;

coolant receiving means at the upper section of said electrode for press connecting with coolant supply means, said receiving and supply means being pressably interengaged within said electrode support arm;

electric current receiving means at said upper electrode section for press connecting with current supply means, said receiving and supply means being pressably interengaged within said electrode support arm; and mechanical fastening means engaging said upper electrode section with said support arm, said electrode section and support arm being thereby mechanically interengaged within said electrode support arm.

2. The electrode and support arm according to claim 1, wherein said support arm includes a recess containing a receiving element having a vertical axis and being open on the bottom side for insertion of said upper electrode section therein.

3. The electrode and support arm according to claim 2, wherein said mechanical fastening means is configured as a bayonet joint, positioned within the receiving element, a bayonet ring of the fastening means being coaxially pivotable in the receiving element of the electrode support arm and radial bayonet locking elements at the upper section of the electrode engaging the bayonet ring of the electrode support arm to lockingly engage the electrode.

4. The electrode and support arm according to claim 3, wherein said electric current receiving means includes an electrical connection member arranged coaxially in said receiving means and having a lower cone-shaped element having a tapered, exterior surface, with there being a ring having a corresponding cone-shape including a tapered exterior surface being located at the upper end of the electrode.

5. The electrode and support arm according to claim 4, wherein said electrical connection member of the support arm and said ring of the electrode when positioned for operation are pressed each against the other by a spring arrangement, said electrical connection member and ring being disconnectable by means of pressure disengagement.

6. An electrode and support arm according to claim 5, wherein a coolant connection member for the supply of liquid coolant is positioned in the support arm recess receiving element and said coolant connection member comprises a coaxial supply duct for press connecting to a central duct of the electrode.

7. An electrode and support arm according to claim 6, wherein the receiving element is equipped with a coolant intake member positioned coaxially with the supply duct and pressably connectable to a discharge duct of the electrode, which discharge duct is coaxially arranged around a central electrode pipe.

8. An electrode and support arm according to any one of claims 1 through 7, wherein said electric current supply means comprises a hollow cylinder case, in which a coolant supply member for the liquid coolant is coaxially arranged, the coolant supply member having a lower part forming a discharge element for the liquid coolant.

9. An electrode and support arm according to any one of claims 1 through 7, wherein said coolant receiving and supply means are ducts contained within electric power supply conduits.

10. An electrode and support arm according to any one of claims 1 through 7, wherein said support arm recess receiving element is located within a portion of said arm which is electrically insulated against the remaining portions of said arm.

* * * * *